US012442619B2

(12) United States Patent
DeRenzo

(10) Patent No.: US 12,442,619 B2
(45) Date of Patent: Oct. 14, 2025

(54) HOLSTER BODY

(71) Applicant: Safariland, LLC, Jacksonville, FL (US)

(72) Inventor: Robert DeRenzo, Saint Johns, FL (US)

(73) Assignee: Safariland, LLC, Jacksonville, FL (US)

( * ) Notice: Subject to any disclaimer, the term of this patent is extended or adjusted under 35 U.S.C. 154(b) by 308 days.

(21) Appl. No.: 18/214,834

(22) Filed: Jun. 27, 2023

(65) Prior Publication Data

US 2024/0011734 A1 Jan. 11, 2024

Related U.S. Application Data

(60) Provisional application No. 63/358,912, filed on Jul. 7, 2022.

(51) Int. Cl.
*F41C 33/02* (2006.01)
*F41H 13/00* (2006.01)

(52) U.S. Cl.
CPC ..... *F41C 33/0209* (2013.01); *F41H 13/0012* (2013.01)

(58) Field of Classification Search
CPC .. F41C 33/02; F41C 33/0209; F41C 33/0218; F41C 33/0227; A45D 34/00; A45D 2034/002; A45D 40/00; A45F 3/00; A45F 2003/006; A45F 2003/001; A45F 2003/003; A45F 2003/142; A45F 2004/003; A45F 2005/008; A45F 2005/1006; A45F 2005/1013
See application file for complete search history.

(56) References Cited

U.S. PATENT DOCUMENTS

| | | | | |
|---|---|---|---|---|
| 9,494,384 | B2 * | 11/2016 | Rogers | F41C 33/0263 |
| 10,473,426 | B2 * | 11/2019 | Tedder | F41C 33/0236 |
| 2007/0181619 | A1 * | 8/2007 | Seyfert | F41C 33/04 224/912 |
| 2016/0273878 | A1 | 9/2016 | Sereday et al. | |
| 2020/0240744 | A1 | 7/2020 | Rogers et al. | |

(Continued)

OTHER PUBLICATIONS

Australian Patent Application No. 2023204212—Examination Report dated Nov. 22, 2024.

(Continued)

*Primary Examiner* — Corey N Skurdal
(74) *Attorney, Agent, or Firm* — Kane Kessler, P.C.; Paul E. Szabo

(57) ABSTRACT

A holster for a weapon such as an electric discharge weapon is made from two pieces joined together to form the holster end wall. The holster right piece has a right end wall part that is molded with both thin wall and also selected thick wall areas that are intentionally molded as thick wall areas. The holster left piece has a left end wall part that is molded to have both thin wall and also selected thick wall areas that are intentionally molded as thick wall areas. When assembled, thin wall areas of the left end wall part overlap thin wall areas of the right end wall part to thereby form a first thick wall region of the holster end wall. Thick wall areas of the right piece end wall part interfit with thick wall areas of the left piece end wall part to form a second thick wall region of the holster end wall.

15 Claims, 9 Drawing Sheets

(56) References Cited

U.S. PATENT DOCUMENTS

2021/0364250 A1* 11/2021 DeSantis ..... F41C 33/0209
2024/0364250 A1 10/2024 Carvell

OTHER PUBLICATIONS

European Patent Application No. 24187851.1—European Search Report dated Jan. 6, 2025.
European Patent Application No. 23184293.1—European Search Report dated Nov. 28, 2023.

* cited by examiner

HOLSTER BODY

BACKGROUND OF THE INVENTION

This invention relates to a holster for a weapon such as a handgun or an electric discharge weapon ("EDW"). An EDW discharges a projectile in the form of an electrically charged metal barb from its muzzle. An EDW holster has a closed end wall at the muzzle. When an EDW is holstered, it is important that, if the weapon discharges accidentally, the barb that is ejected from the muzzle does not pass through the end wall.

Holsters for EDW weapons are often made from molded plastic. Molding an entire holster end wall from thick wall plastic, thick enough to stop the barb, can be complex and expensive. If a thinner plastic end wall is used, which is not itself sufficient to stop a barb, a metal plate may need to be molded into the end wall, adding to the expense and complexity of the manufacturing process.

SUMMARY OF THE INVENTION

In one aspect, the invention relates to a holster for a weapon such as an electric discharge weapon that has a muzzle that discharges a projectile. The holster includes side walls and an end wall together forming a chamber for receiving the weapon in a position in the chamber with the muzzle adjacent to the holster end wall. The holster comprises a holster right piece having a right end wall part that is molded to have thin wall areas but also having selected thick wall areas that are intentionally molded as thick wall areas; and a holster left piece having a left end wall part that is molded to have thin wall areas but also having selected thick wall areas that are intentionally molded as thick wall areas. The right piece and the left piece are connectable with each other to form the holster with the right and left end wall parts abutting at a joining line to thereby form the holster end wall. Thin wall areas of the left end wall part overlap thin wall areas of the right end wall part to thereby form a first thick wall region of the holster end wall. Thick wall areas of the right piece end wall part interfit with thick wall areas of the left piece end wall part to form a second thick wall region of the holster end wall.

In another aspect, the invention relates to a method of manufacturing a holster for a hand held weapon such as an electric discharge weapon that has a muzzle, the holster including side walls and an end wall together forming a chamber for receiving the weapon in a position in the chamber with the muzzle adjacent to the holster end wall. The method includes the steps of molding a holster right piece having a right end wall part; molding a holster left piece having a left end wall part; and connecting the right piece and the left piece with each other to form the holster with the right and left end wall parts abutting at a joining line to thereby form the holster end wall. The step of connecting the right piece and the left piece includes the step of overlapping a thin wall portion of the right end wall part with a thin wall portion of the left end wall part thereby to form a thicker wall region that is located in front of the muzzle of a weapon holstered in the holster.

In addition, the end wall parts may be formed with interlocking portions to minimize gapping and to resist inward and outward movement of the holster end wall.

BRIEF DESCRIPTION OF THE DRAWINGS

Further features of the invention will become apparent to one of ordinary skill in the art to which the invention pertains, from a reading of the following specification together with the accompanying drawings, in which.

DESCRIPTION OF EMBODIMENTS

The present invention relates to a holster for a handgun such as an electric discharge weapon ("EDW"). The invention is applicable to holsters of different configurations and uses. As representative of the invention, FIG. 1 illustrates a holster 10 that is a first embodiment of the invention.

The holster 10 in use may include several attachments, for example, a belt clip or tuck device. These attachments do not form part of the present invention, and so are not described in detail herein.

The present invention is applied in the manufacture of the holster 10. The holster 10 includes generally two pieces that are manufactured separately then moved together laterally to overlap and interlock, then secured together in a know manner, to form the assembled holster 10. These two pieces are, for convenience only, referred to herein as the "right piece" and the "left piece". Those terms (right and left) are used to indicate the relative positioning of the holster 10 in space in a particular orientation as viewed in some of the drawings herein. The terms right and left are not intended to be limiting herein, including in the claims. Thus, a described feature or a claimed element that is indicated as being on the "right piece" may alternatively be on the "left piece", or vice versa (or top-bottom, for example), and the product will still fall within the ambit of the invention. One might also refer to the two holster pieces as the "first piece" and the "second piece", or as the "face side piece" and the "body side piece".

Figure 1:
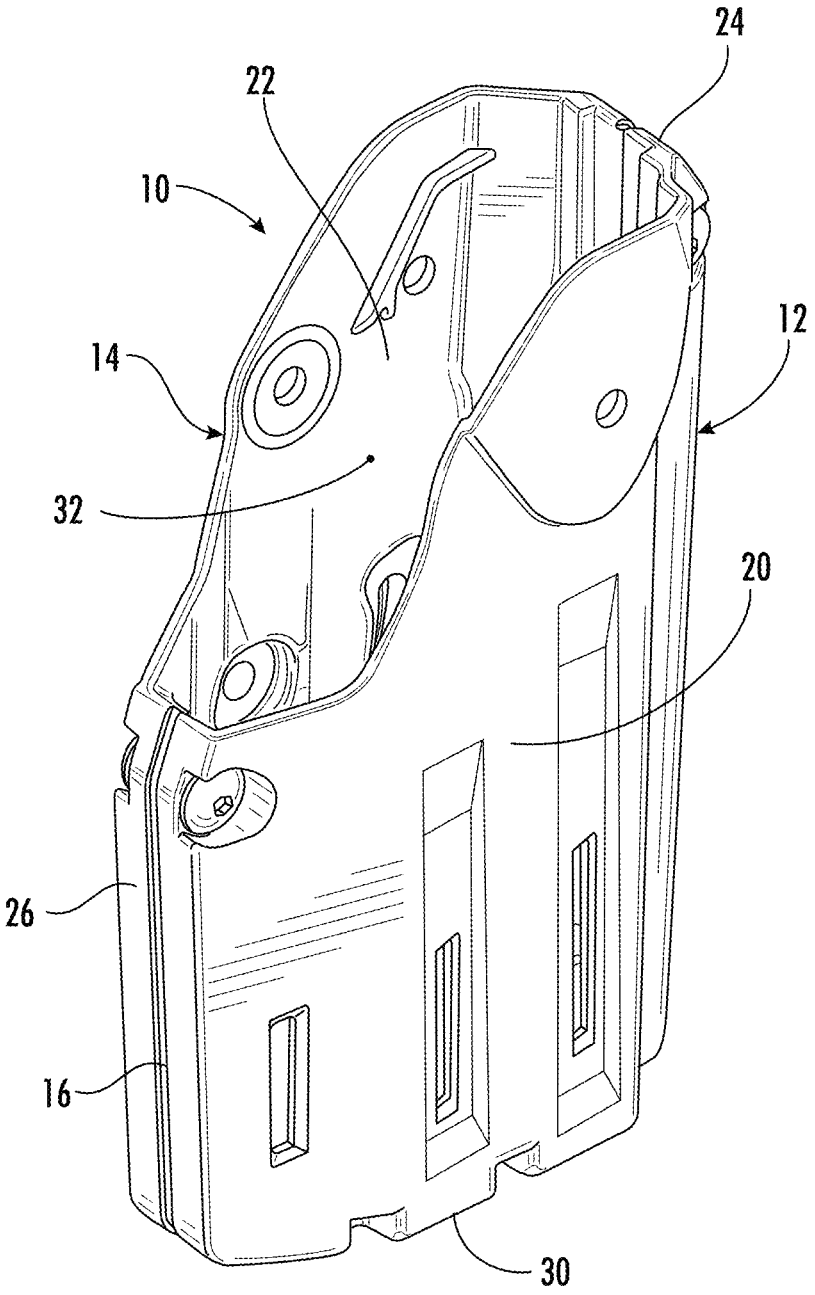
FIG. 1 is a right side perspective view of a holster that is a first embodiment of the invention.
Figure 2:
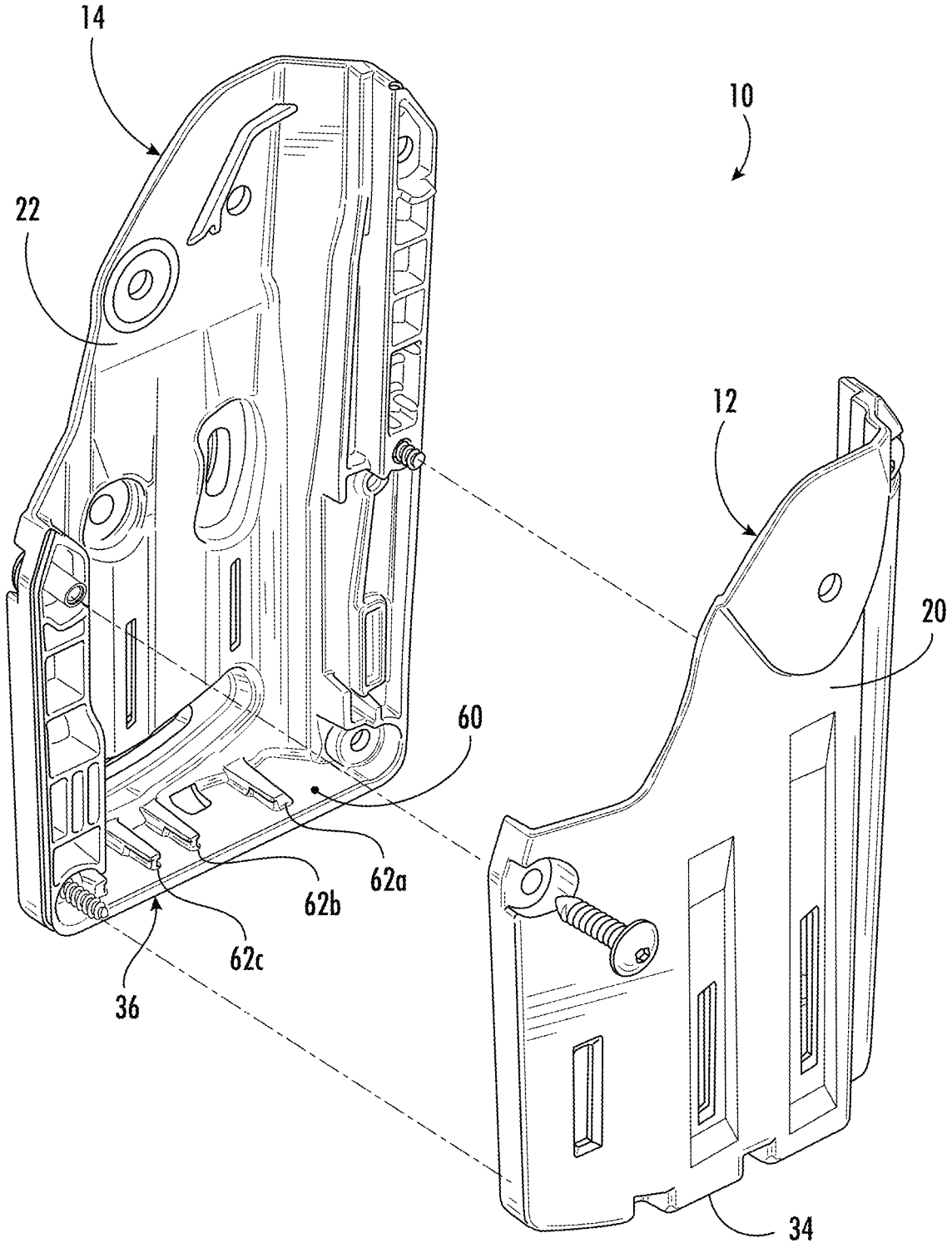
FIG. 2 is an exploded perspective view of the holster of FIG. 1, showing the left and right holster pieces separated from each other.
Figure 3:
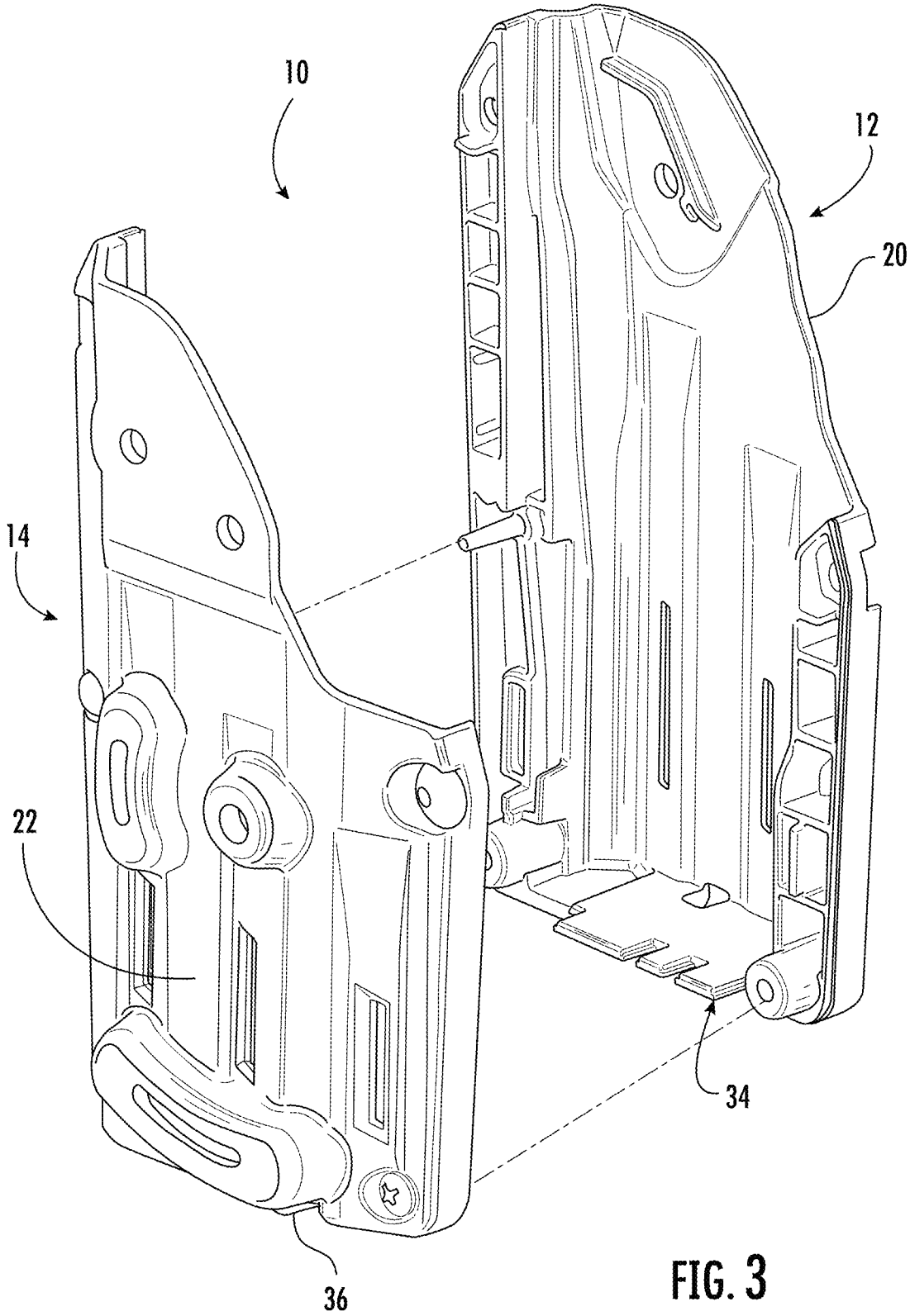
FIG. 3 is a left side perspective view similar to FIG. 2.

As one example, the holster 10 shown in FIG. 1 is made from two pieces, a right piece 12 and a left piece 14 as illustrated from the rear view, that is, looking into the entranceway of the holster 10 toward the holster end wall. The right and left pieces 12 and 14 nominally abut (join) along a centerline or joining line indicated at 16 to form the holster 10, although there is some overlap as described below.

The assembled holster 10 includes a right side wall 20, a left side wall 22, a top wall 24, a bottom wall 26, and an end wall 30. Together, the several holster walls form or define a chamber 32 for receiving the weapon in a position in the chamber with its muzzle adjacent to the holster end wall 30.

The right and left side walls 20 and 22 of the holster 10 are each formed as one piece on the right and left holster pieces 12 and 14, respectively. In contrast, the holster top wall 24, the holster bottom wall 26, and the holster end wall 30 are each formed by adjoining and abutting portions of the right piece 12 and the left piece 14, respectively. In the holster 10, it is the construction of the holster end wall 30 that embodies the present invention.

Specifically, the holster end wall 30 includes a right end wall part 34, which is molded as part of the right piece 12, and a left end wall part 36, which is molded as part of the left piece 14. When the right and left pieces 12 and 14 are joined as described below, the right end wall part 34 and the left end wall part 36 together form, or constitute, the holster end wall 30.

Each one of the right and left end wall parts 34 and 36 is molded with both (a) one or more standard wall thickness (or "thin wall") areas, similar to the remainder of the holster, and (b) one or more thickened (or "thick wall") areas, as described below. When the right end wall part 34 is joined with the left end wall part 36, because of this selective molding and also some overlap, most of the resulting holster end wall 30 is thick walled, as desired for its function.

In accordance with the invention, the two end wall parts 34 and 36 are molded with one or more thick wall areas on each part. The right piece thick wall areas interfit with the left piece thick wall areas, when the holster is assembled, to form one thick walled region. In addition, some thin wall areas on the left piece overlap with thin wall areas on the right piece, to form another large thick wall region. Together, these thick wall regions combine to make a holster end wall that has a relatively large overall percentage of its area configured as thick wall.

In one particular commercial product that embodies the invention, the thin wall areas are ⅛" (0.125") thick. The thick wall areas are ¼" (0.25") thick. When two thin wall areas overlap, they form a thick wall region that is ⅛" (0.125") thick. Since most of the resulting holster end wall 30 is thick walled, and the barb of an EDW is typically less than ¼" (0.25") in length, if the EDW is accidentally fired in the holster 10, it will not protrude beyond the holster end wall 30.

Figure 4:
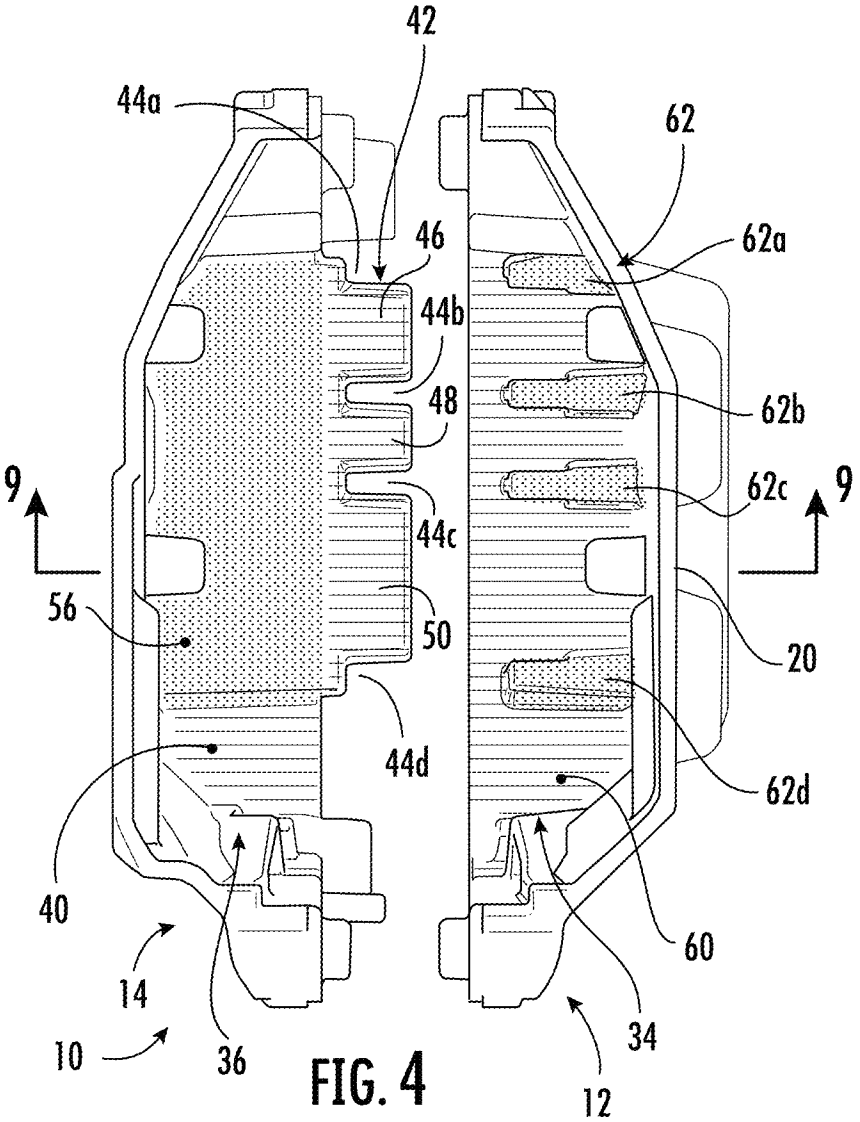
FIG. 4 is a schematic inside view of the left and right holster pieces, showing the left and right end wall parts before assembly to each other.

The left end wall part 36 (FIG. 4) is molded with two thin wall areas, designated by the reference numerals 40 and 42 in FIG. 4 and delineated by horizontal surface shading lines. One of these thin wall areas, specifically the area 40, extends inward of the joining line 16 (to the left as viewed in FIG. 4), or in a direction away from the right piece 12, up to the left piece end wall part 36. It does not project laterally past the joining line 16.

The other thin wall area on the left piece 14, specifically, the area 42, projects laterally past or outward of the joining line 16 (to the right as viewed in FIG. 4, for example) in a direction toward the right piece 12. Four notches are formed in this projecting area 42. One notch 44*a* is located at the top of the area 42; two notches 44*b* and 44*c* are located toward the middle (top to bottom) of the area 42; and one notch 44*d* is located at the bottom of the area 42. These notches 44*a*-44*d* have a relatively short vertical dimension, compared to their lateral length. The four notches 44*a*-44*d* define between them three tabs 46, 48, and 50, which project beyond the joining line 16. In other embodiments, there could be a different number of notches and tabs.

Figure 5:
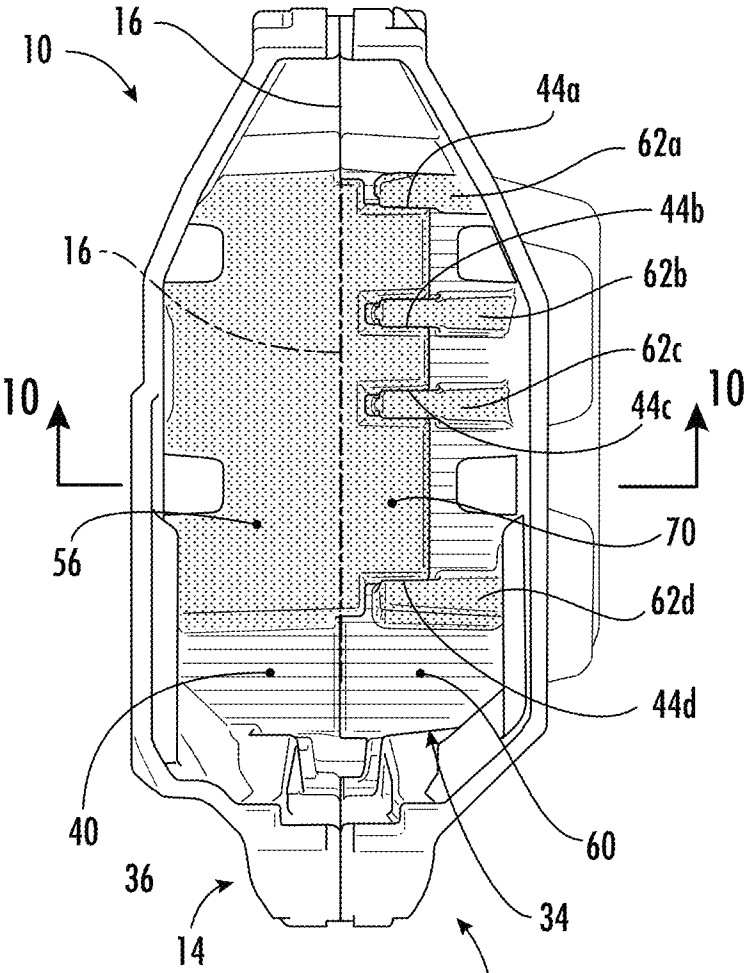
FIG. 5 is a schematic inside view of the left and right holster pieces, shown after assembly to each other.

In addition to the two thin wall areas 40 and 42, the left end wall part 36 is molded with one relatively large thick wall area 56, delineated by stippled surface shading in FIGS. 4 and 5. This thick wall area 56 extends up to but does not project laterally past or outward of the joining line 16 (to the right as viewed in FIG. 4). This thick wall area 56 is bounded on the top by the upper locking area of the left end wall part 36; on the right by the three tabs 46, 48, and 50 of the thin wall area 42; on the bottom by the thin wall area 40; and on the left by the left side wall 22 of the holster 10.

This thick wall area 56 is relatively large. It makes up in the range of from about 70% to about 85%, and preferably about 82%, of the inner surface area of the left end wall part 36. The thin wall areas 40 and 42 together make up in the range of from about 15% to about 30%, and preferably about 18% of the inner surface area of the left end wall part 36.

The right end wall part 34 (FIG. 4) is, like the left end wall part 36, molded with both thin wall and thick wall areas. Specifically, the right end wall part 34 is molded with one thin wall area 60, delineated by horizontal line surface shading. This thin wall area 60 does not project laterally past the joining line 16 (to the left as viewed in FIG. 4, for example). Rather, it extends laterally between the joining line 16 and the right side wall 20 of the holster right piece 12.

Substantially within this thin wall area 60, the right end wall part 34 is molded with at least one thick area 62. In the particular illustrated embodiment, the area 62 comprises a plurality of (in this case four) thicker wall profile ("thick wall") areas, in the form of ribs 62*a*-62*d*, delineated by stippled surface shading. The ribs 62*a*-62*d* do not project laterally past the joining line 16 (to the left as viewed in FIG. 4). Further, in this embodiment, they do not extend up to the joining line 16. The ribs 62*a*-62*d* have a shape that is complementary to that of the notches 44*a*-44*d* in the left end wall part 36. Thus, the ribs 62*a*-62*d* have a relatively short vertical dimension as compared to their lateral extent. The four ribs 62*a*-62*d* are laterally opposite the four notches 44*a*-44*d* when the right piece 12 and the left piece 14 are aligned for assembly, as shown in FIGS. 4 and 5.

On the right end wall part 34, the thick section area 62 makes up in the range of from about 75% to about 85%, and preferably about 80% of the inner surface area, and the thin wall area 60 makes up in the range of from about 15% to about 25%, and preferably about 20%, of the inner surface area of the right end wall part 34.

In assembly of the right piece 12 with the left piece 14 (FIGS. 4 and 5), the two pieces 12 and 14 are moved together laterally toward and into engagement with each other, as in FIG. 5. At this point, the right and left end wall parts 34 and 36 abut at the joining line 16. This process forms the assembled holster end wall 30.

During this assembly process, the thin wall tabs 46, 48, and 50 on the left end wall part 36 of the left piece 14 fit between (interfit with) the ribs 62*a*-62*d* on the right end wall part 34 of the right piece 12. The tabs 46-50 overlie the thin wall area 60 of the right end wall part 34, in an overlap area indicated by the reference numeral 70 in FIG. 5, to the right of the joining line 16 in FIG. 5. This overlap area 70, because it has two layers of material, is thick walled, as a result.

In addition, the ribs 62*a*-62*d* of the right end wall part 34 fit within (interfit with) the notches 44*a*-44*d* of the left end wall part 36, forming a part of and further increasing the amount of surface area of the holster end wall 30 that is thick walled.

The overlap area 70 is a part of the overall thick wall region or area of the assembled end wall 30, as shown in FIG. 5, that is located on both sides of the joining line 16. This thick wall region also includes the four ribs 62*a*-62*d* of the right piece 12, as well as the thick wall area 56 of the left piece 14. This thick wall region is a large part, perhaps 80% or more, of the overall area of the end wall. As a result, the holster end wall 30 has the desired barb resistance property.

Figure 8:
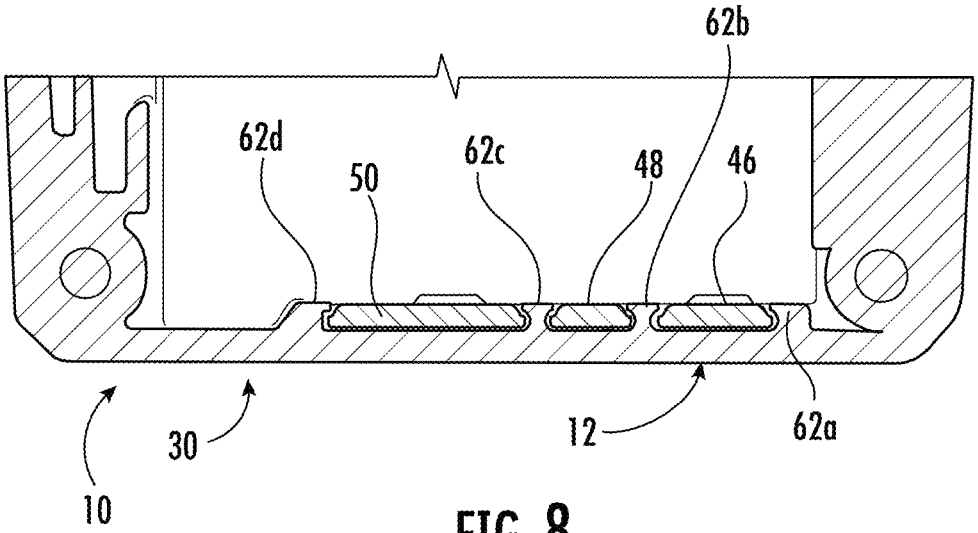
FIG. 8 is a partial sectional view of the assembled end wall.
Figure 9:
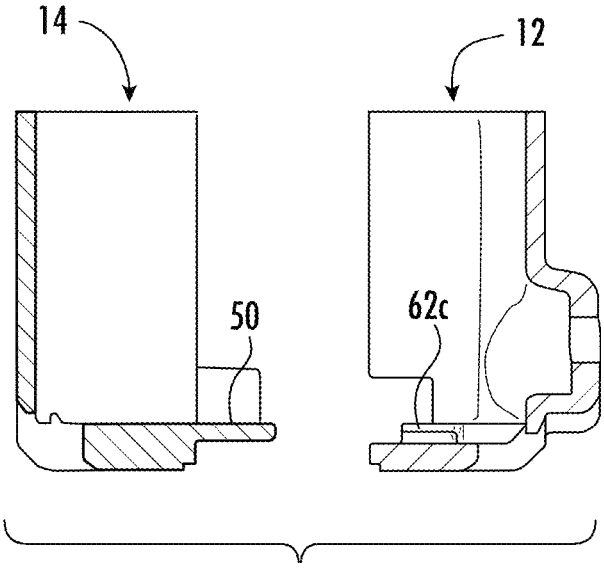
FIGS. 9 and 10 are partial sectional views illustrating assembly of the interlock feature of the holster end wall.
Figure 10:
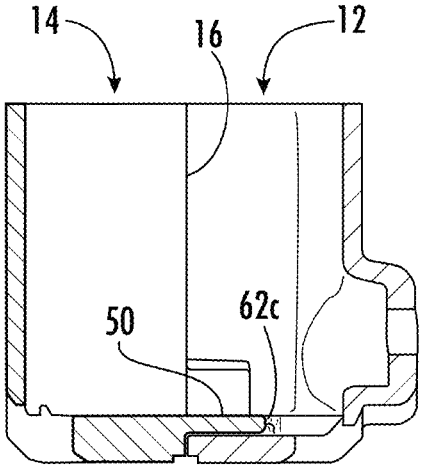

In accordance with a further feature of the invention, the ribs 62*a*-62*d* and the notches 44*a*-44*d* are formed with grooves or dovetails (FIGS. 8-10), along their edges, to provide an interlock, not merely an overlap. Thus, for example, each right piece rib 62*a*-62*d* has a generally trapezoidal shape in cross-section that is wider at the inside (facing the chamber 32) and narrower on the outside. Similarly, the tabs 46, 48, and 50 on the opposite left piece 14, which abut the ribs 62*a*-62*d*, are undercut along the laterally extending edges of each notch 44*a*-44*d* that receives a rib. Therefore, when a rib is slid into a notch, the right piece 12 and the left piece 14 interlock in an inward-outward direction. This interlocking engagement helps to prevent inward/outward movement (up-down as viewed in FIGS. 8-10 of the end wall pieces 12 and 14.

The result is a holster end wall 30 that is substantially entirely thick wall in nature, capable of blocking passage of an accidentally discharged EDW barb, while requiring only minimal molding of large surface area thick wall portions of the end wall parts 34 and 36. In addition, the two pieces 12 and 14 interlock along the end wall 30, providing a much stronger end wall as the result; the interlocking helps to hold the pieces 12 and 14 together and minimize gapping. This is the result of the ribs 62*a*-62*d* entering into the notches 44*a*-44*d* and interlocking there.

Figure 6:
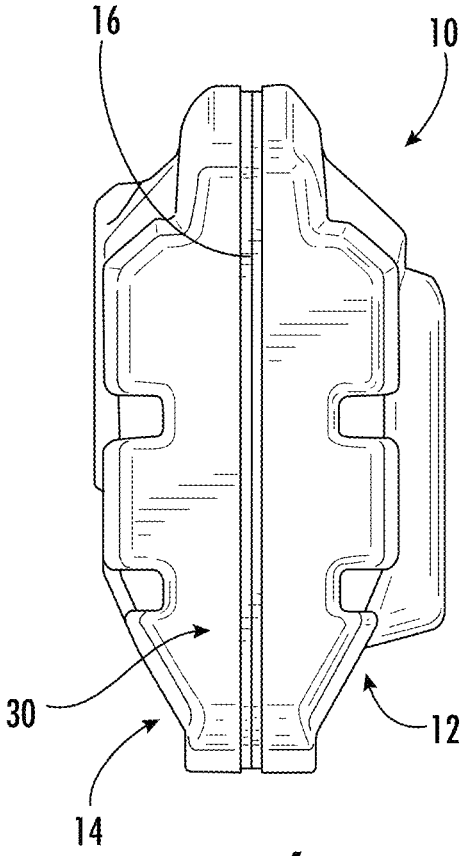
FIG. 6 is an exterior view of the holster end wall when assembled.
Figure 7:
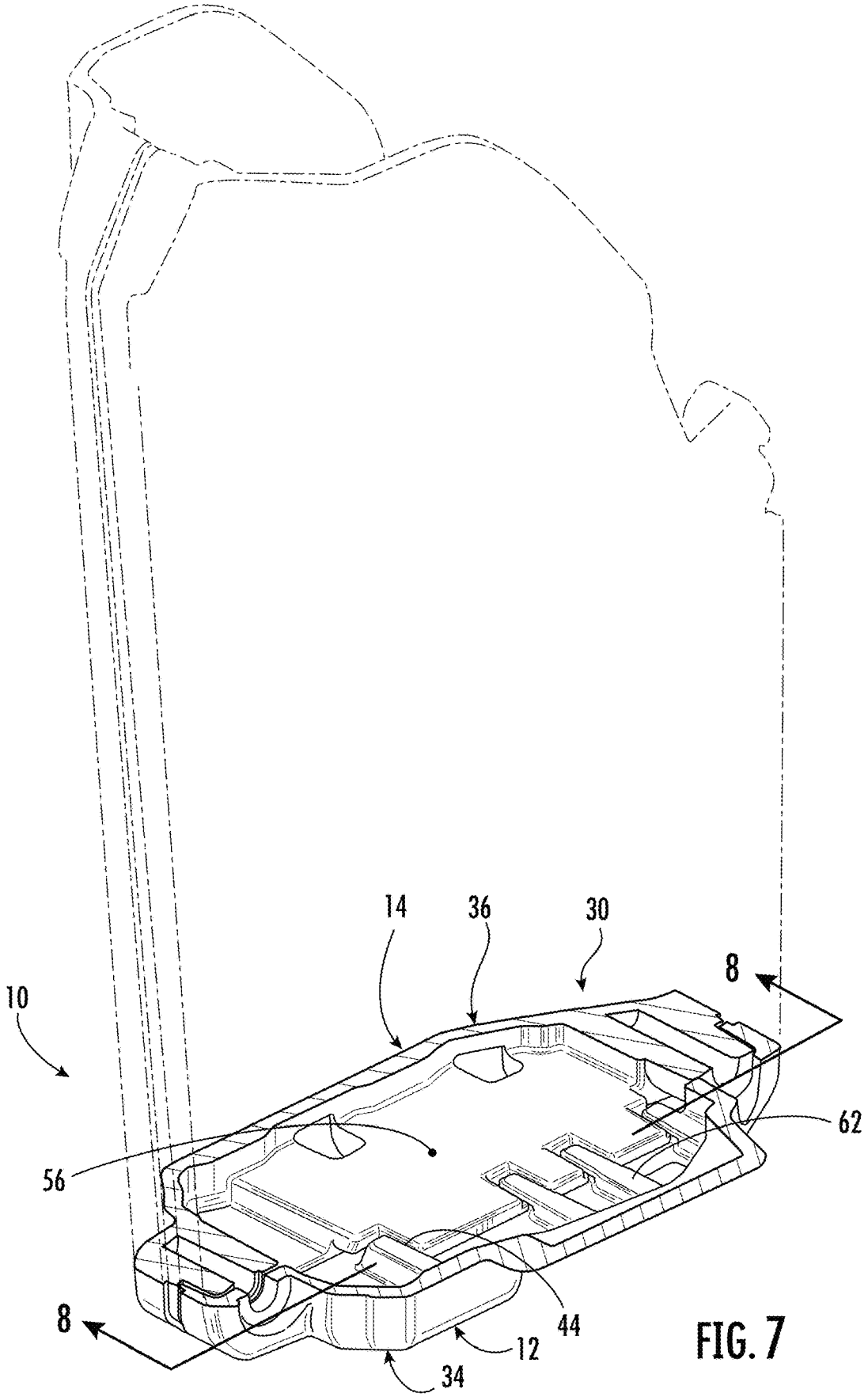
FIG. 7 is a cutaway perspective view of the inside of the holster end wall, shown assembled.

Also, the exterior of the end wall 30 (FIG. 6) appears clean and uniform. The joining line 16 is visible, but the interlocks are not visible, because they are on the interior of the holster 10. Specifically, all the thick wall areas of the end wall 30 are thickened (from the nominal overall thin wall section) in a direction inward, toward the chamber 32. Overall, the invention thus provides a visually attractive holster 10 with the required strength, and reduced gapping, made by a simpler molding process.

Only one of the two holster pieces 12 and 14 needs to be molded with thick wall areas that are large in surface area, not both pieces. Specifically, the thick walled but narrow ribs 62*a*-62*d* on the right piece 12 are not a problem to mold, even though they do have a relatively large wall thickness, because each rib is relatively small in surface area. The thick wall area 56 on the left piece 14 is potentially more problematic to mold because it is larger in surface area and may be susceptible to shrinkage and/or warpage. But this issue can be easily addressed by adding more cooling in the mold. There are several ways to do this; for example, the use of a copper plate to absorb heat during the molding process. Having the thick wall ribs 62*a*-62*d* on the right piece 12 be narrow, means that a more expensive and complex molding process for thick sections is needed on only one of the two holster pieces 12 and 14. This reduces expense and difficulty in the manufacturing process.

In the embodiment of FIGS. 1-10, the additional material thickness that is needed to provide the thicker end wall is all provided on the inside of the holster. However, as noted, the one large area 56 of thick wall on the left piece results in the need for a more complex molding process. That need can be eliminated if that one large area can be eliminated.

Figure 11:
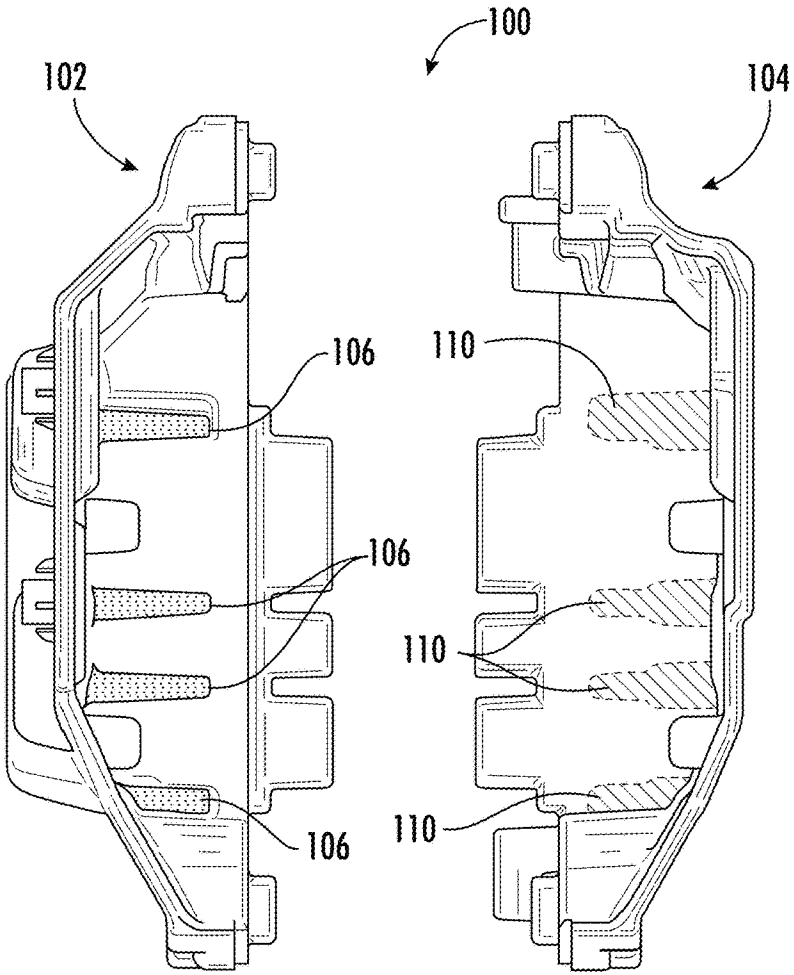
FIG. 11 is an inside view of a holster that is a second embodiment of the invention, before assembly.

In that regard, FIGS. 11-14 illustrate a holster 100 which is a second embodiment of the invention and which eliminates that one large area of thick wall section. FIG. 11 shows the two holster pieces 102 and 104 from the inside, before assembly. Thick wall areas 106 that are visible in this view, are only on the inner surface of the left piece 102. Those areas are illustrated with stippling and solid line borders. Thick wall areas 110 that are not visible in this view (i.e., behind the plane of the paper) are only on the outer surface of the right piece 104. Those areas 110 are illustrated with diagonal lines and dash line borders.

Figure 12:
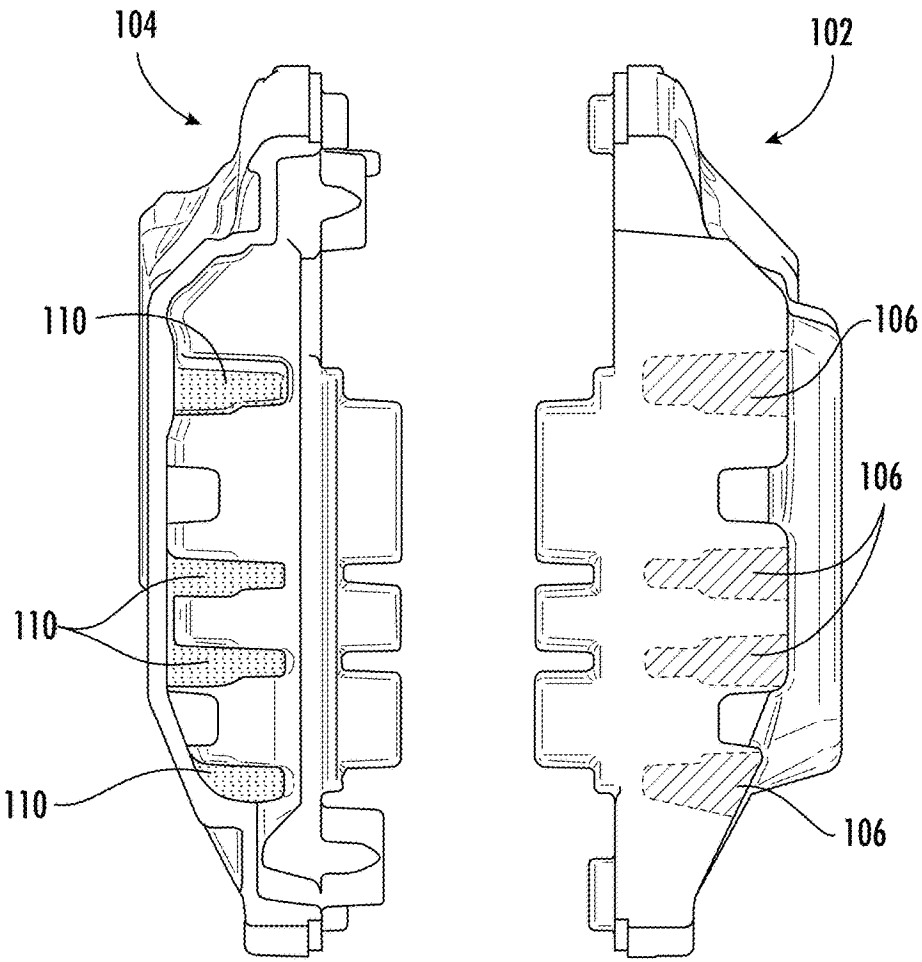
FIG. 12 is an outside view of the holster of FIG. 11, before assembly.

FIG. 12 shows the two holster pieces from the outside, before assembly. The thick wall areas 110 that are visible in this view are only on the outer surface of the right piece end wall part 112, and are illustrated with stippling and solid line borders. The thick wall areas 106 that are not visible in this view (i.e., behind the plane of the paper) are only on the inner surface of the left piece end wall part 108, and are illustrated with diagonal lines and dash line borders. There is no one large area of thick section wall like the area 56 (FIGS. 1-10).

Figure 14:
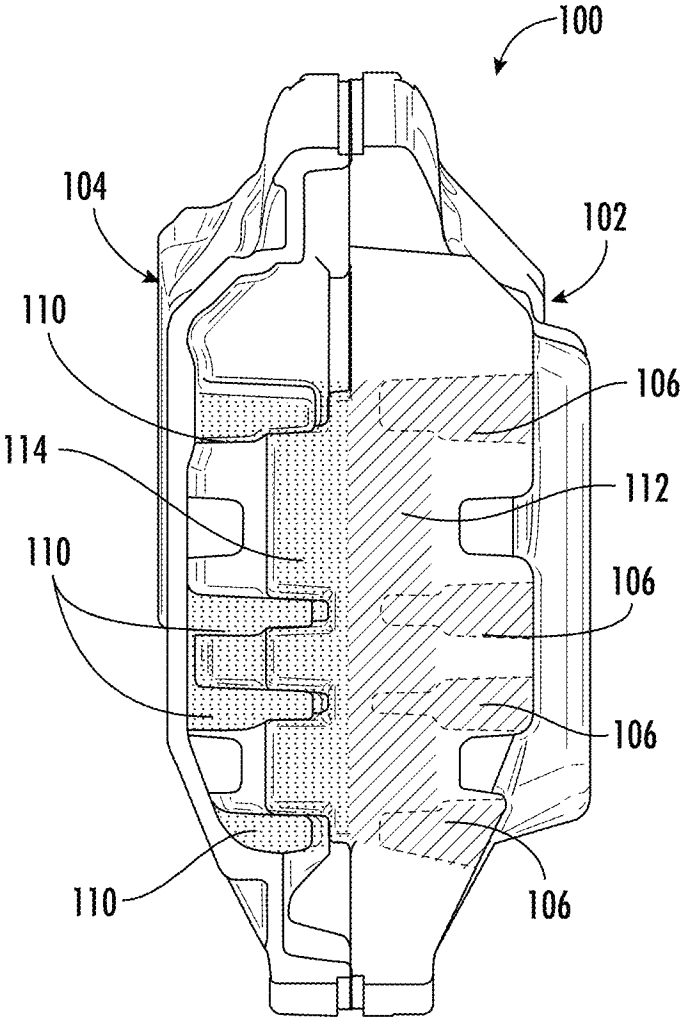
FIG. 14 is an outside view of the holster of FIG. 11, after assembly.
Figure 13:
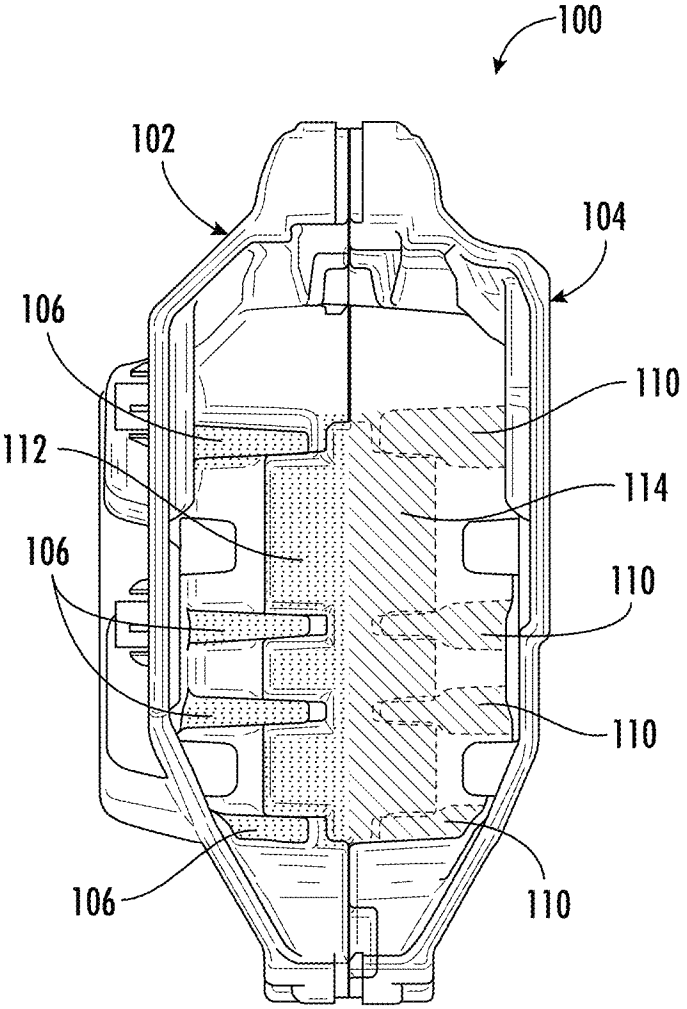
FIG. 13 is an inside view of the holster of FIG. 11, after assembly.

FIGS. 13 and 14 illustrate the assembled holster end wall; FIG. 13 from the inside, and FIG. 14 from the outside. Two areas of overlap are formed; one area 112 that is on the inside, and one area 114 that is on the outside. These areas of overlap are thick wall areas, and are similarly shaded as in FIGS. 11 and 12.

The result is that the end wall of the holster 100 has a relatively large portion of its surface area that is thick wall, like the first embodiment. This embodiment or configuration maintains the desired finished end wall thickness and reduces the complexity of the molding process. One aspect of this configuration is that the various ribs and overlaps are to a significant extent visible on the outside of the holster end wall, which may be less desirable from an appearance point of view.

From the above description of the invention, those skilled in the art will perceive improvements, changes and modifications in the invention. Such improvements, changes and modifications within the skill of the art are intended to be covered by the appended claims.

The invention claimed is:

1. A holster (10) for a weapon that is made from a right piece (12) and a left piece (14) that abut along a joining line (16) to form the holster;

the assembled holster includes a right side wall (20), a left side wall (22), a top wall (24), a bottom wall (26), and an end wall (30), which together define a chamber (32) for receiving the weapon in a position in the chamber with its muzzle adjacent to the holster end wall (30);

the right and left side walls (20, 22) of the holster (10) are each formed as one piece on the right and left holster pieces (12, 14), respectively;

the holster top wall (24), the holster bottom wall (26), and the holster end wall (30) are each formed by adjoining and abutting portions of the right piece (12) and the left piece (14), respectively;

the holster end wall (30) includes a right end wall part (34) which is molded as part of the right piece (12) and a left end wall part (36) which is molded as part of the left piece (14), whereby when the right and left pieces (12, 14) are joined along the joining line (16), the right end wall part (34) and the left end wall part (36) together form the holster end wall (30);

wherein, when the holster (10) is assembled, a first thin wall area (42) of the left end wall part (36):

projects laterally past the joining line (16) in a direction toward the right piece (12), and overlies a thin wall area (60) of the right end wall part (34) which extends laterally between the joining line (16) and the right side wall (20), thereby forming a thick wall overlap area (70) that is located on both sides of the joining line (16) and defines a large part of the overall area of the end wall (30).

2. A holster as set forth in claim 1, wherein the left end wall part (36) is molded with the first thin wall area (42) and a second thin wall area 40 that extends inward of the joining line (16), wherein the first and second thin wall areas (42, 40) together make up from about 15% to about 30% of the inner surface area of the left end wall part (36).

3. A holster as set forth in claim 2 wherein the thick wall overlap area (70) is located in front of the muzzle of a weapon when holstered in the holster.

4. A holster as set forth in claim 2 wherein each holster end wall part is molded with thick wall areas (56, 62), which together with the overlap area constitute at least about 70% of the area of the holster end wall.

5. A holster as set forth in claim 4 wherein the left end wall part is molded with one large thick wall area (56) that constitutes in the range of from about 80% to about 85% of the surface area of the left end wall part.

6. A holster as set forth in claim 1 wherein when the holster is assembled the overlap area (70) is substantially contiguous with the at least one thick wall area (56) of the left end wall part and is substantially contiguous with at least one thick wall area (62) of the right end wall part.

7. A holster as set forth in claim 1 wherein all the thick wall portions of the left and right end wall parts together constitute at least about 80% of the area of the assembled holster end wall.

8. A holster as set forth in claim 1 wherein the at least one thick wall area (62) of the right end wall part comprises a plurality of elongate ribs (62*a*, 62*b*, 62*c*, 62*d*) that do not project past the joining line (16), each one of the ribs having a surface area that is substantially less than the surface area of each thick wall area of the left end wall part.

9. A holster as set forth in claim 1 wherein selected portions of the left end wall part and the right end wall part interfit with each other via interlocking material portions, to minimize inward and outward movement of the holster end wall parts.

10. A holster as set forth in claim 9 wherein the interlocking material portions comprise dovetail joints.

11. A method of manufacturing a holster for a hand held weapon such as an electric discharge weapon that has a muzzle, the holster including side walls and an end wall together forming a chamber for receiving the weapon in a position in the chamber with the muzzle adjacent to the holster end wall, the method comprising the steps of:

molding a holster first piece having a right end wall part;

molding a holster second piece having a left end wall part; and connecting the first piece and the second piece with each other to form the holster with the first and second end wall parts abutting at a joining line to thereby form the holster end wall;

the step of connecting the first piece and the second piece includes the step of overlapping a first thin wall area of the left end wall part with a thin wall area of the right end wall part thereby to form a thick walled overlap area (70) that is located on both sides of the joining line 16 and defines a large part of the overall area of the end wall (30).

12. A method as set forth in claim 11 wherein the left end wall part (36) is molded with the first thin wall area (42) and a second thin wall area (40) that extends inward of the joining line (16), wherein the first and second thin wall areas (42, 40) together make up from about 15% to about 30% of the inner surface area of the left end wall part.

13. A method as set forth in claim 12 wherein the overlap area (70) is located in front of the muzzle of a weapon when holstered in the holster.

14. A method as set forth in claim 12 wherein each one of the second piece and the first piece includes a plurality of thick wall narrow ribs and no larger thick wall areas.

15. A method as set forth in claim 11 wherein;

the step of molding a holster first piece having a left end wall part comprises molding the left end wall part with both thin wall areas and one or more thick wall areas;

the step of molding a holster second piece having a right end wall part comprises molding the right end wall part with both thin wall areas and at least one thick wall areas;

and the step of connecting the first piece and the second piece includes the step of interfitting at least one thick wall area of the second piece with at least one thick wall area of the first piece.

* * * * *